US006414833B1

(12) United States Patent
Estudillo

(10) Patent No.: US 6,414,833 B1
(45) Date of Patent: Jul. 2, 2002

(54) MULTIPLE ACTUATOR CONTROL CIRCUIT

(75) Inventor: Lauro P. Estudillo, La Palma, CA (US)

(73) Assignee: Ducommon Technologies, Inc., Carson, CA (US)

( * ) Notice: Subject to any disclaimer, the term of this patent is extended or adjusted under 35 U.S.C. 154(b) by 0 days.

(21) Appl. No.: 09/590,801

(22) Filed: Jun. 9, 2000

(51) Int. Cl.[7] ..... H01H 47/00
(52) U.S. Cl. ..... 361/152; 361/166; 361/153
(58) Field of Search ..... 361/139, 143, 361/152, 153, 160, 166, 167, 191; 307/41

(56) References Cited

U.S. PATENT DOCUMENTS 4,144,552 A * 3/1979 Sibalis ..... 361/166
4,241,376 A * 12/1980 Ardrey ..... 361/166
4,327,693 A * 5/1982 Busser ..... 123/490
5,889,645 A * 3/1999 Kadah et al. ..... 361/191
5,982,052 A * 11/1999 Sosnowski ..... 307/126

* cited by examiner

*Primary Examiner*—Kim Huynh
(74) *Attorney, Agent, or Firm*—J. E. Brunton

(57) ABSTRACT

An energy efficient multiple actuator control circuit is disclosed comprising a timing-slicing circuit for arranging and processing a pulsed select signal into a plurality of staggered pulse signals and a steering logic circuit for receiving the pulse signals and generating corresponding actuator enable signals. Latching solenoid actuators are arranged into position upon receipt of the pulsed actuator enable signals. The actuators maintain their position without any additional power. The circuitry is hardwired in that for a given select signal each actuator is activated into a predetermined position. The circuitry is scalable to arrange any plurality of actuators in any prearranged configuration, and the circuitry can perform properly over a broad variation of select signals.

5 Claims, 10 Drawing Sheets

MULTIPLE ACTUATOR CONTROL CIRCUIT

BACKGROUND OF THE INVENTION

1. Field of the Invention

The invention relates in general to actuator control circuitry and, in particular, to a multiple actuator control circuit capable of arranging a plurality of push-pull latching actuators into a plurality of predetermined positions of a prearranged configuration upon the receipt of a single select signal. The circuitry is scalable in that it can arrange any number of actuators into any number of prearranged configurations upon receipt of a separate select signal corresponding to each prearranged configuration.

2. Description of the Prior Art

It is well known in many industries to utilize solenoid type actuators as switches for controlling fluid flow, gas flow, and the like. As new actuator designs have been introduced in order to reduce power consumption, so to has new circuitry been designed to control them. One new actuator design of recent years has been the latching solenoid. The latching solenoid has an advantage in utilizing less power than conventional solenoids.

One circuit for controlling a bistable actuator is disclosed in U.S. Pat. No. 4,409,638 issued to Sturman et al. The control circuit in Sturman is integrated into the actuator that is intended to replace conventional solenoid actuators controlling water flow in such devices as dishwashers, sprinklers, and the like. Compared to conventional solenoid actuators the integrated latching actuator in Sturman consumes substantially less power in the actuated state however the input signal must remain on at all times in order to keep the actuator in position. Maintaining the coil of the actuator in an energized state in order to maintain the actuator in a predetermined position is highly undesirable in applications where available power is generally scarce.

Another circuit for controlling a number of direct current operated solenoid valves is disclosed in U.S. Pat. No. 5,909,353 issued to Alberter et al. Although the circuit in Alberter is primarily designed to reduce power loss by retrieving the magnetic energy stored in the inductive coils of the solenoids when the power is turned off, the solenoids must initially be maintained in an energized state by the power source. Hence, maintaining the solenoids in a given position requires the continuous supply of direct current power to the solenoid. This is undesirable in low power applications.

In recent years, considerable research effort has taken place in the field of electromagnetic devices for space applications. This research has led to the development of energy-efficient, small-envelope, low-weight latching actuators. Uniquely, these devices can maintain their selected position when their inductive coils are disconnected from the power source. As used herein, a "latching actuator" refers to a switching device having at least two positions in which either position, once achieved, can be maintained without the application of a power source. The latching force for the positions of the switch are generally produced by permanent magnets, and switching between positions is accomplished by energizing the coils for a brief period of time at a magnitude sufficient to transfer the actuator armature from one latched position to another. The dual position push-pull inductive solenoid, or bistable actuator, is one example of a latching actuator.

The thrust of the present invention is to provide a highly reliable, energy efficient, scalable control and drive system for latching actuators adapted for use in reduced power applications such as in space. These and other difficulties of the prior art have been overcome according to the present invention.

BRIEF SUMMARY OF THE INVENTION

A preferred embodiment of the energy efficient multiple actuator control circuit according to the present invention comprises a timing-slicing circuit for arranging and processing a select signal into a plurality of staggered pulse signals and a steering logic circuit for receiving the pulse signals and generating corresponding actuator enable signals. An actuator enable signal is generated for each actuator to be controlled and preferably each enable signal has a duration greater than the actuator switching time rating of its corresponding actuator. The circuitry is hardwired in that for a given select signal each actuator is arranged into its own predetermined position. The predetermined positions of all the actuators makeup a prearranged configuration or actuator output. The circuitry is scalable to achieve any multiple of prearranged configurations of the actuators by providing separate select signal path for each prearranged configuration.

In one embodiment the actuators are push-pull latching solenoids having two opposed switch positions. These latching bistable solenoids do not require a constant power source to energize their inductive coils in order to maintain either switch position. Switching from one position to the other only requires the application of a reverse polarity enable signal or pulse. Latching is typically accomplished mechanically or with permanent magnets. These solenoids are well suited for use with the present invention control circuit as they can be activated to either position by the application of a pulse enable signal without the need for a continuous power supply. One such suitable bistable solenoid is disclosed in the U.S. Patent Application filed on even date herewith and identified by Attorney Docket No. 20025. Thus, the present invention control circuit significantly differs from a conventional electronic transistor type switch in that it does not utilize a small input signal to activate a short circuit path for continuous power flow.

A significant advantage to the present invention circuitry is that the select signal can substantially vary in voltage, current, and duration, yet still achieve the desired result of arranging the actuators into the prearranged configuration. This makes the circuitry well adapted for applications where high switching reliability is required yet the power available for achieving such switching varies. Thus the present invention circuitry is well suited for spacecraft applications, remote robotics, and the like.

The control circuit is able to arrange a plurality of actuators into a plurality of predetermined positions by the receipt of a single select signal. The single select signal is preferably a brief direct current pulse signal. Advantageously the select signal does not have to be continuously applied to maintain the actuators in their predetermined positions. The control circuit is able to achieve the desired actuation even when the select signal varies substantially in voltage, current or duration. The circuit is energy efficient as actuation is achieved by the select signal alone without the assistance of an additional power source.

The circuitry of the present invention is capable of accurately arranging the actuators into their predetermined positions in response a single select signal that can vary greatly in voltage, current and duration. The circuitry is scalable in that it can arrange any number of actuators into any number of prearranged configurations upon receipt of a separate select signal corresponding to each prearranged configuration.

BRIEF DESCRIPTION OF THE DRAWINGS

Referring particularly to the drawings for the purposes of illustration and not limitation.

DETAILED DESCRIPTION OF THE PREFERRED EMBODIMENTS

Referring particularly to the drawings there is illustrated generally at 10 an actuator control circuit. The actuator control circuit 10 is shown schematically in FIGS. 1 and 2, and comprises a timing slicing circuit 12, a steering logic circuit 14 and actuator drivers 16, 18, and 20. Three separate signal paths are provided at 22, 24, and 26 in which a single select signal pulse can be applied. Any number of separate signal paths can be provided, if desired. Each signal path correspond s to a prearranged configuration of all the actuators. The three actuator drivers 16, 18, and 20 respectively control three separate actuators, however, any number of actuators and drivers can be provided, if desired. Each actuator has two positions, a forward position (Fwd) and reverse position (Rev), and for each signal path provided there is a corresponding predetermined position (either Fwd or Rev) for each actuator. Each actuator has an actuator switching time rating. As used herein, an "actuator switching time rating" is the time required to activate the switch from one position to the other. The actuator switching time rating is typically measured in milliseconds and varies substantially depending on a given actuator design.

Figure 1:
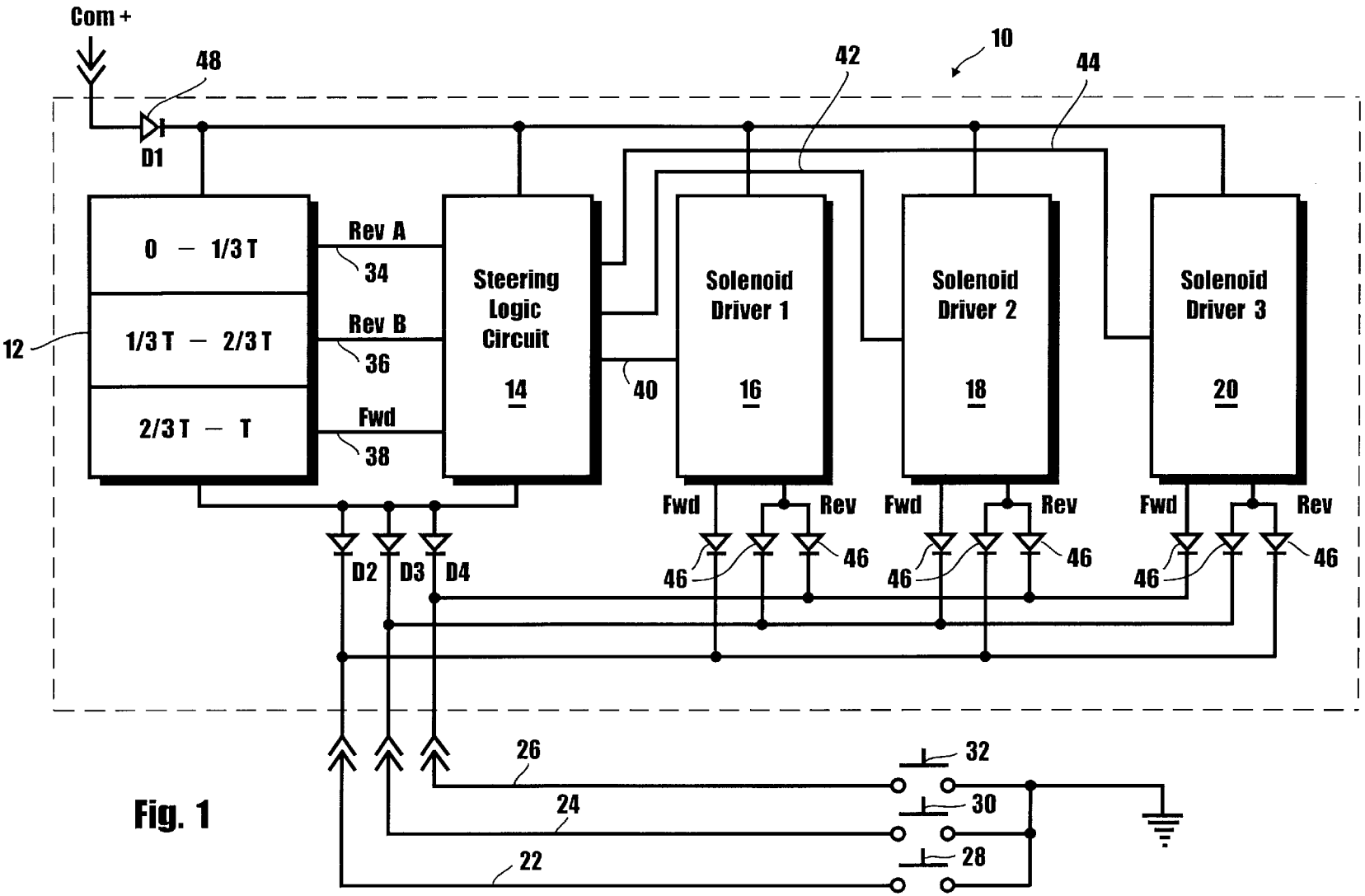
FIG. 1 is a schematic block diagram of the actuator control circuit of the present invention where the select signal is negative.
Figure 2:
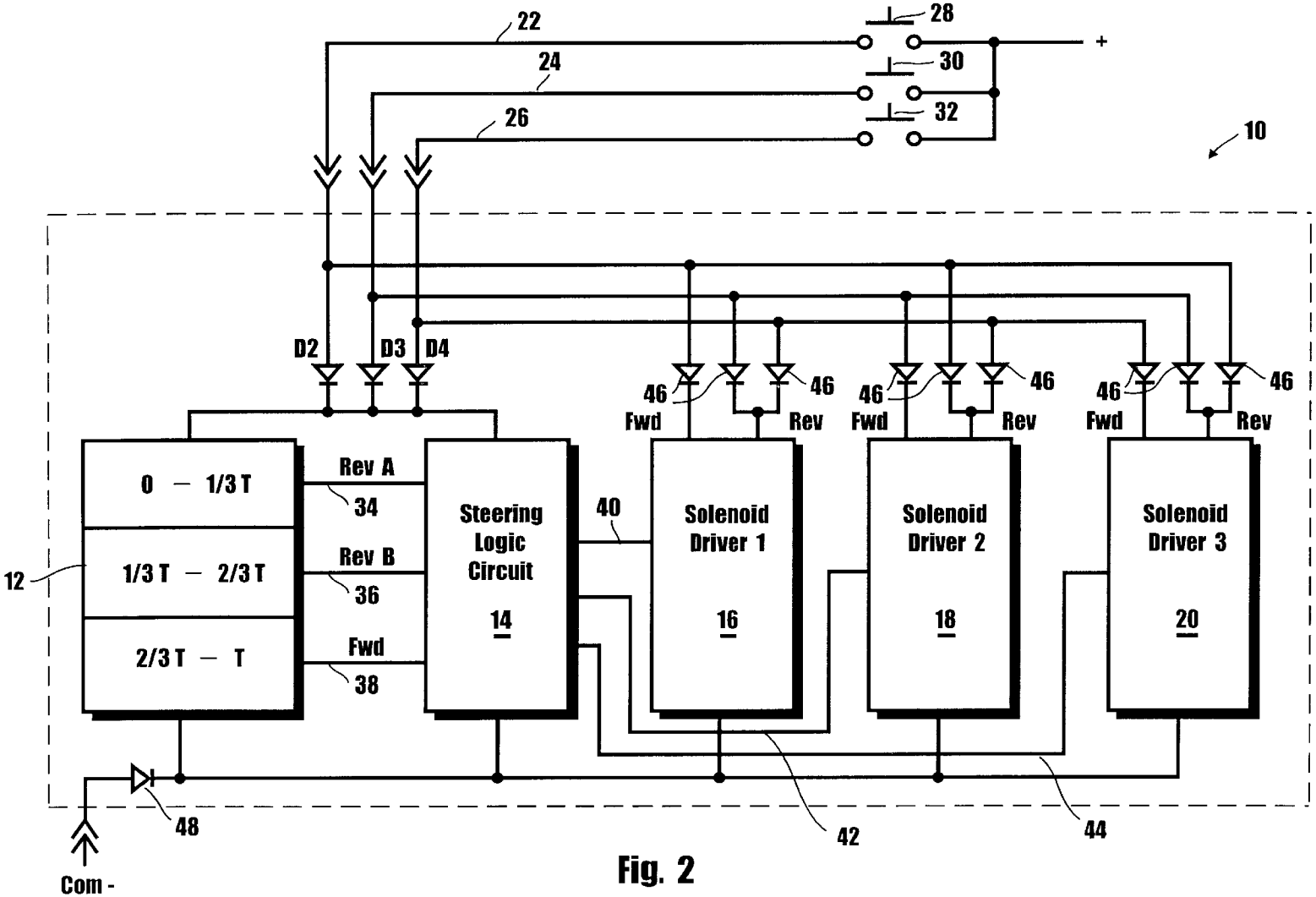
FIG. 2 is a schematic block diagram of the actuator control circuit of the present invention where the select signal is positive.

In the schematics shown in FIGS. 1 and 2, when single select signal 22 is energized by the momentary closure of contact 28, the actuator associated with driver 16 is moved to its Fwd position, the actuator associated with driver 18 is moved to its Rev position, and the actuator associated with driver 20 is moved to its Rev position. When select signal 24 is energized by the momentary closure of contact 30, driver 16 moves its actuator to its Rev position, driver 18 moves its actuator to its Fwd position, and driver 20 moves its actuator to its Rev position. When select signal 26 is energized, driver 16 moves its actuator to its Rev position, driver 18 moves its actuator to its Rev position, and driver 20 moves its actuator to its Fwd position. Hence, each select signal path has a predetermined position for each actuator that, in combination establishes a prearranged configuration of the actuators. The prearranged configurations of the select signals shown in the figures are exemplary only and can be modified accordingly depending on the requirements of a given control application.

Figure 3:
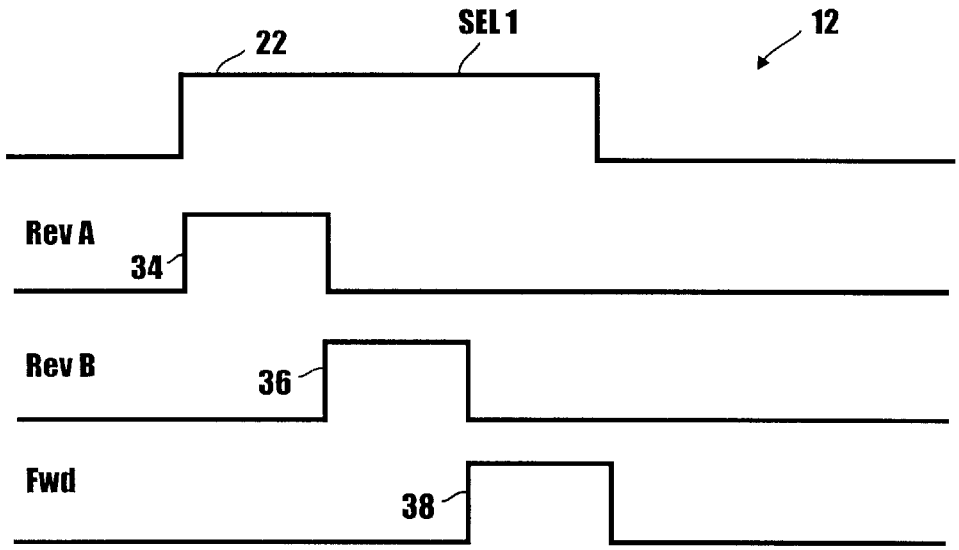
FIG. 3 is a timing diagram of the relationship of solenoid actuation in response to a given select signal.

The schematics of the control circuit shown in FIGS. 1 and 2 comprise 3 main logical sections; the timing-slicing circuit 12, the steering logic circuit 14, and the solenoid drivers 16, 18, and 20. The single select signal is provided through either path 22, 24, or 26, upon the momentary closure of respective contacts 28, 30, and 32. The only difference between the schematics of FIGS. 1 and 2 is that in FIG. 1 the select signal is negative and in FIG. 2 the select signal is positive. The duration of the select signal is noted as "T" in the schematics, and the timing-slicing circuit divides the select signal pulse into staggered pulse signals. The number of staggered pulse signals equals the number of actuators for a given control circuit. FIG. 3 charts the division of select signal pulse of path 22 into three staggered pulse signals 34, 36, and 38, by the timing-slicing circuit 12. The staggered pulse signals are delivered to the steering logic circuit 14, which in turn processes these signals and generates corresponding actuator enable signals 40, 42, and 44. The enable signals are then delivered to the actuator drivers.

Distributing available current of the single select signal by time-slicing it among the actuators substantially minimizes the power requirements of the multiple actuator control circuit. In addition, by providing a single select signal pulse at or near the full input voltage rating of the actuators allows operation of the circuitry over a wide input voltage range.

The steering logic section directs the staggered pulse signals 34, 36, and 38 to the appropriate solenoid drivers as enable signals 40, 42, and 44 such that if select signal path 22 is momentarily energized, driver 18 and 20 will energize their actuators in the reverse direction (Rev) and driver 16 will energize its actuator in the forward direction (Fwd). The steering logic section in effect incorporates the predetermined configuration of each separate select signal. Thus, the steering logic section must be designed to deliver the enable signals to the actuators according to their predetermined position for each predetermined configuration.

The diodes 46 in each driver sections have dual functions. They function as part of the solenoid drivers and also as part of the steering logic. Diode D1 protects the circuit from accidental application of input voltage in reverse and makes the circuitry inoperative until the condition is corrected. Diodes D2, D3 and D4 make power available to the timing and steering sections when any of the switch position selection pulse is present.

The function of the timing-slicing and steering sections may be implemented using a microcontroller or digital logic integrated circuits. However, the high cost and limited availability of such screened components may be a deciding factor in excluding the use of microcontroller or digital integrated circuits in some applications.

The following embodiments make use of discrete semiconductors that are readily available in screened versions.

These embodiments have a wide input operating voltage range and do not require fixed voltage for operation as microcontrollers or digital integrated circuits do. FIGS. 4 through 9 show embodiments designed to accept negative voltage select signal pulses having duration "T" of 100 milliseconds.

Figure 4:
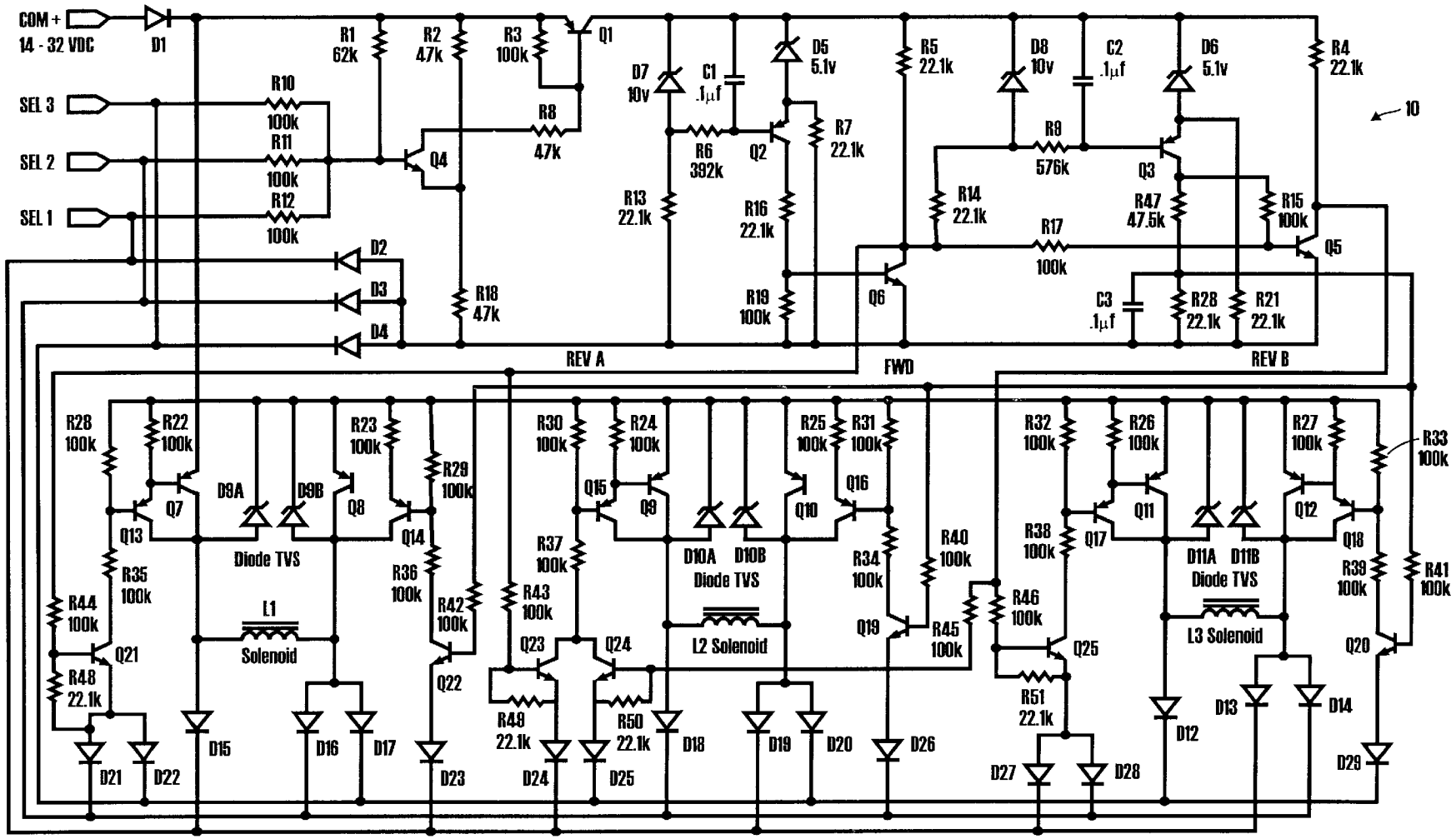
FIG. 4 is a schematic circuit diagram of the actuator control circuit controlling three actuators and having three select signal path inputs for receiving negative input signals.

In the preferred embodiment referred to for purposes of illustration, in FIG. 4 is the multiple actuator control circuit 10 adapted to receive negative voltage select signal pulses. In this embodiment three actuators are controlled whose actuator solenoids are designated as L1, L2, and L3 respectively, however more or less actuators may be controlled, if desired. The following description will be described when select signal position 1 is energized by connecting SEL 1 terminal to the supply ground. It is desirable that the pulse duration of the SEL 1 signal approximately equal to or greater than the sum of all the actuator switching times. In the embodiments shown, each actuator switching time rating is, for example 25 milliseconds, and the pulse duration should at least approximately equal or exceed the sum total of the switching time ratings. Although the sum total for the three switches in the embodiments shown is 75 milliseconds, the pulse duration of the SEL 1 signal is preferably set for 100 milliseconds. The outputs of actuator solenoids L1, L2, and L3 in this example correspond to the outputs previously discussed and shown in the chart of FIG. 3.

SELECT SIGNAL INPUT SECTION

Figure 5:
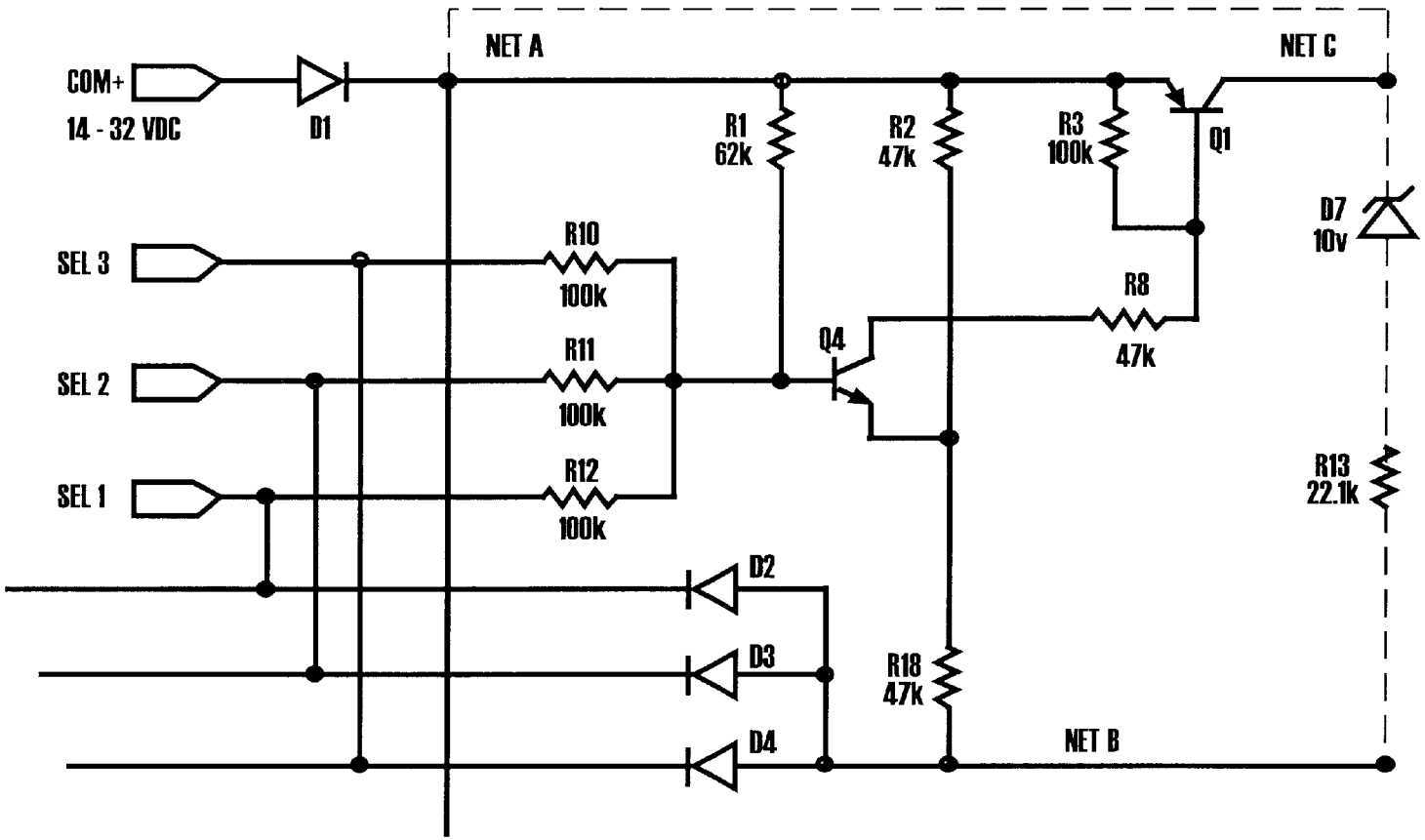
FIG. 5 is a schematic circuit diagram of the input section of the actuator control circuit of FIG. 4.

FIG. 5 shows the select signal input section of the circuit of FIG. 4. The COM+ terminal is connected to a positive voltage supply. D1 provides protection for the circuit against reverse polarity. When SEL 1 is at ground, D2 conducts bringing circuit NET B close to supply ground. Since the values of R2 and R18 are equal, the voltage at the emitter of Q4 is one half that of the input voltage. Current flows through R1 and R12 and since the value of R1 is lower than that of R12, the base of Q4 is more positive than its emitter, causing Q4 to conduct. Q4 causes the base of Q1 to be more negative than its emitter through R8 causing Q1 to conduct. The conducting Q1 provides input power to the timing and steering logic sections.

If one or two more other select signal switch positions are inadvertently energized at the same time as SEL 1, R12 will effectively be in parallel with R10 and/or R11. The effective resistance of R12 in parallel with R10 and/or R11 is lower than R1 and will make the base of Q4 negative compared to its emitter, turning Q4 off and turning Q1 off. With Q1 off, the timing and steering logic sections are disabled and the entire circuit becomes inoperative. R1, R2 R3, R8, R10, R11, R12, R18, Q4 and Q1 can be deleted if it can be guaranteed that only one select signal position will be selected at any given time. If deleted, circuit NET A is connected directly to circuit NET C as shown by the top dashed line in FIG. 5.

TIMING-SLICING SECTION

Figure 6:
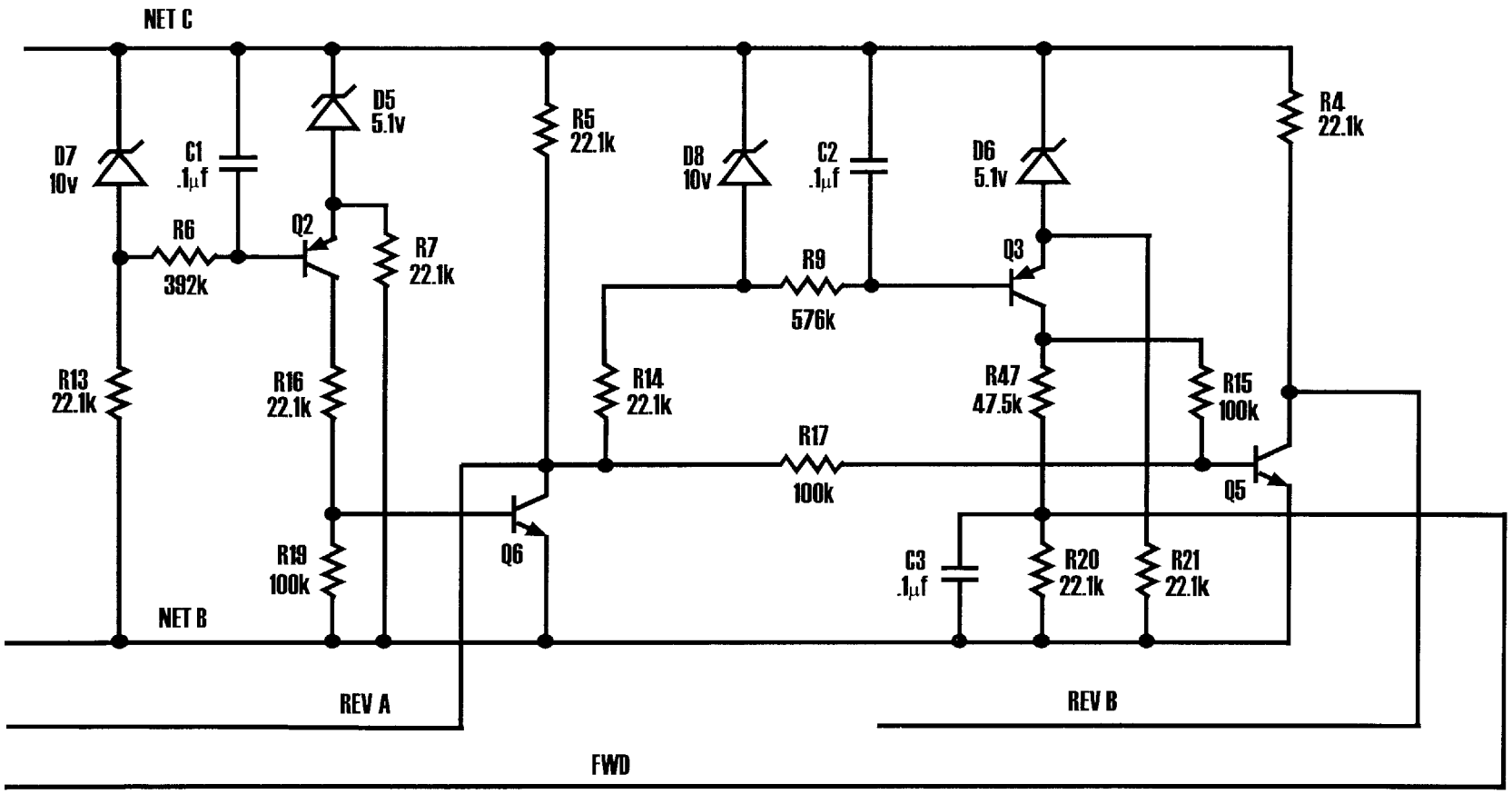
FIG. 6 is a schematic circuit diagram of the timing section of the actuator control circuit of FIG. 4.

FIG. 6 shows the timing-slicing section. This section generates the internal staggered pulse signals designated as REV A, REV B, and FWD. Q2 and Q3 turn on after a delay time set by the RC network at their bases. The RC network values are selected for a delay of about 33 milliseconds. The Zener diodes and associated resistors, D7–R13, D5–R7, D8–R14, and D6–R21 stabilize the delay time over the input voltage range. At the beginning of the select pulse, Q2, Q3 and Q6 are initially off. With Q6 off, circuit net REV A is positive through R5. R17 applies a positive voltage to the base of Q5, which is turned on. With Q5 on, circuit net REV B is close to supply ground. Circuit net FWD is also close to supply ground because Q3 is still off. These conditions create the first ⅓ of the internal staggered pulse signal sequence.

Initially the anode of D7 is at −10 volts from NET C charging C1 through R6. After about 33 milliseconds, Q2 turns on, which then turns on Q6. With Q6 on, circuit REV A goes down close to supply ground. With Q3 still off, R17 stops applying positive voltage to the base of Q5, which turns Q5 off. With Q5 off, circuit net REV B becomes positive through R4. These conditions create the second ⅓ of the internal staggered pulse signal sequence.

The turn on of Q6 makes the anode of D8 at −10 volts from NET C1, charging C2 through R9. After about 33 milliseconds (about 66 milliseconds from the start of the select pulse), Q3 turns on making circuit net FWD positive. The turn on of Q3 applies positive voltage to the base of Q5 through R15, turning on Q5. With Q5 on, circuit net REV B is again close to supply ground. Q3 is left in the on condition making circuit net FWD positive until the select pulse disappears. The net FWD is taken from the junction of C3, R20, and R47 which delays the FWD signal to prevent it from being on at the same time as the REV B signal. Q6 is still on making circuit net REV A close to supply ground. These conditions create the last ⅓ of the internal staggered pulse signal sequence.

Referring to FIG. 3, the REV A, REV B, and FWD staggered pulse signals, designated as 34, 36, and 38 respectively, preferably have a pulse duration that is equal to or greater than the actuator switching time ratings of the actuators. This is preferred since the pulse duration of each enable signal matches the pulse duration of its corresponding staggered pulse signal, and the enable signal must be long enough to insure complete switching of the actuators. In the embodiments shown, the SEL 1 pulse duration is 100 milliseconds which, when split, provides a pulse duration of 33 milliseconds for each staggered pulse signal. Providing a 33 millisecond duration of the staggered pulse insures complete switching of all actuators since it somewhat exceeds 25 millisecond actuator switching time rating of each actuator. The staggered pulse signals do not need to have the same pulse duration as shown, and they can accordingly vary particularly when the switches have different actuator switching time ratings.

ACTUATOR SOLENOID DRIVER 1 AND STEERING LOGIC

Figure 9:
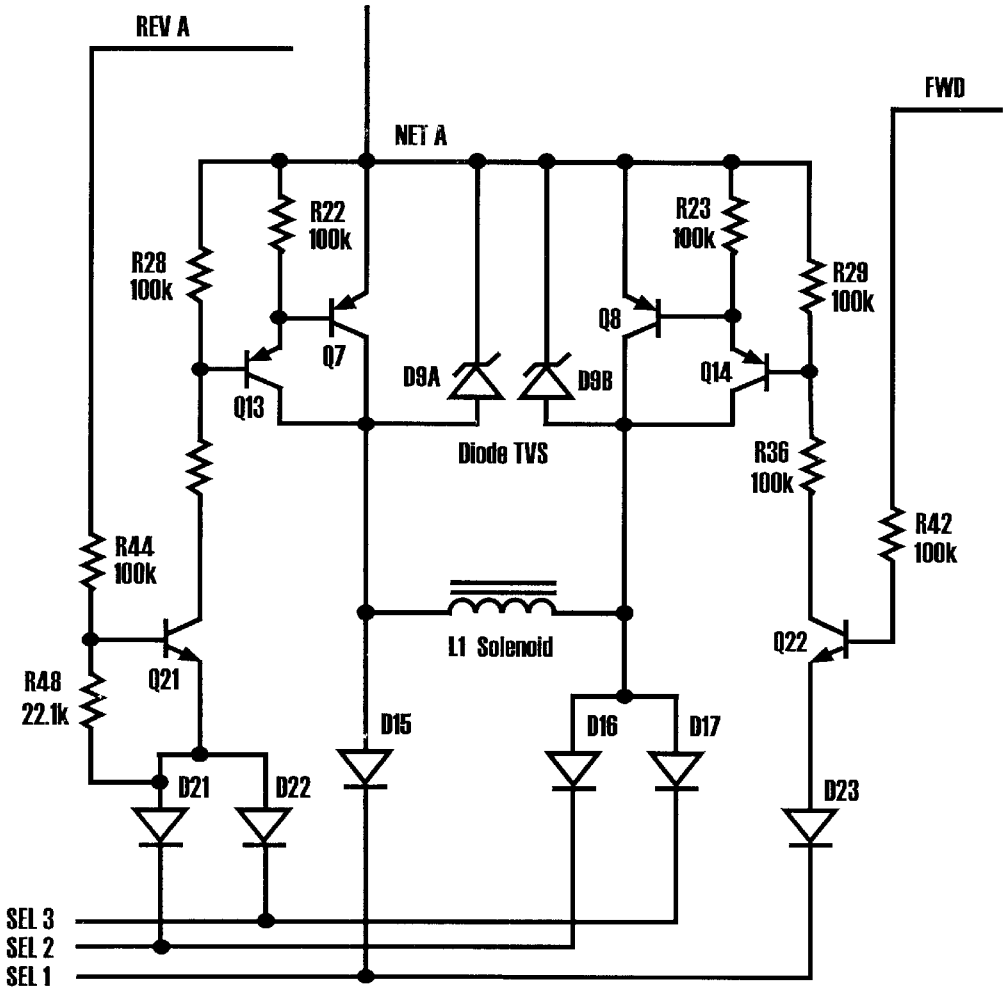
FIG. 9 is a schematic circuit diagram of the first solenoid driver and steering logic of the actuator control circuit of FIG. 4.

FIG. 9 shows the actuator solenoid L1 driver and steering logic. Q7, Q8, Q13, Q14, R22, R23, R28, R29, D9A, D9B, D15, D16 and D17 form the solenoid driver. Q21, Q22, R35, R36, R44, R42, R48, D21, D22, and D23 form the steering logic. Diodes D15, D16, and D17 are also part of the steering logic.

When select signal SEL 1 is activated, D15 and D23 will conduct while the other diodes function as open circuits. During the last ⅓ of the selection pulse the staggered pulse FWD is positive turning on Q22 through R42. Q22 makes the base of Q14 negative through R36 with respect to NET A. Q14 and Q8 are turned on making the right side of solenoid L1 positive. The left side of solenoid L1 is close to supply ground through D15. Under these conditions the solenoid L1 moves to the on position during the last ⅓of the selection pulse. D9A and D9B protect the driver transistors by clamping the spikes generated by the solenoid when current through the solenoid is abruptly cut off.

ACTUATOR SOLENOID DRIVER 2 AND STEERING LOGIC

Figure 7:
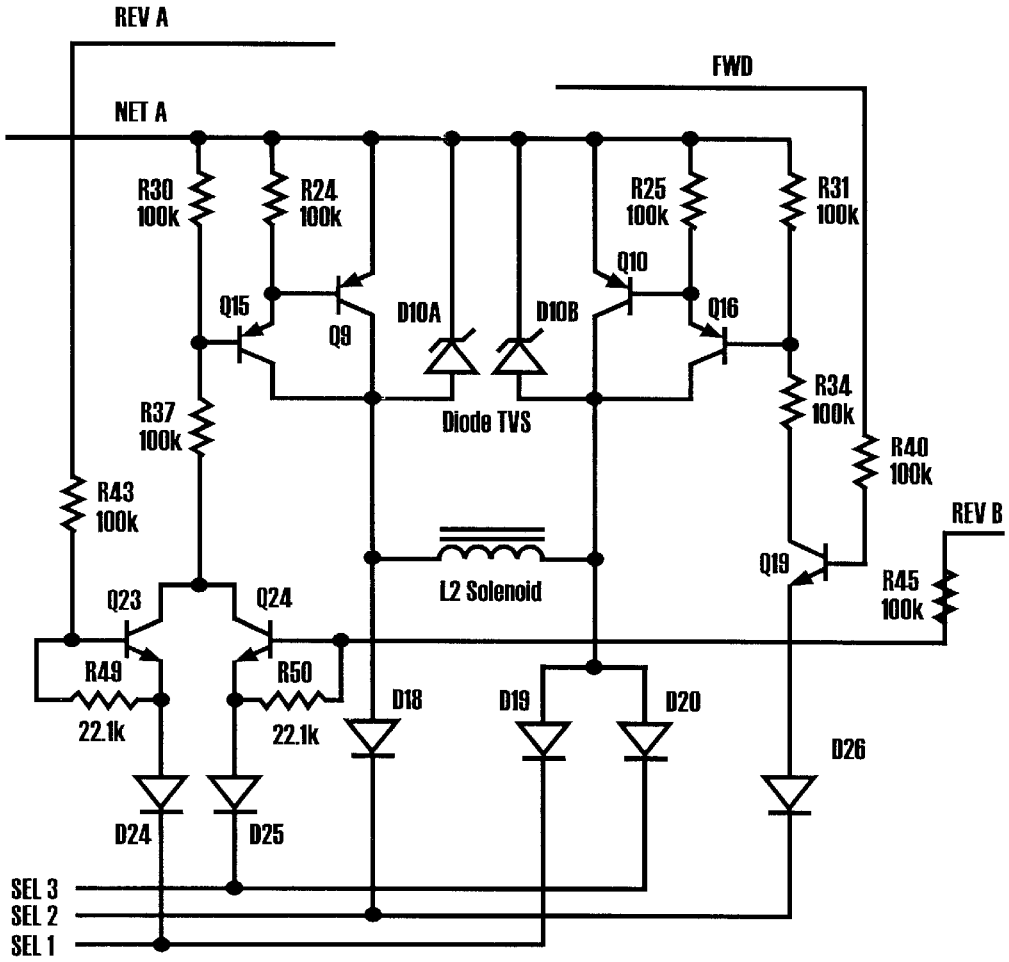
FIG. 7 is a schematic circuit diagram of the second solenoid driver and steering logic of the actuator control circuit of FIG. 4.

FIG. 7 shows the actuator solenoid L2 driver and accompanying steering logic. Q9, Q10, Q15, Q16, R24, R25, R30, R31, D1OA, D1OB, D18, D19 and D20 form the solenoid driver. Q23, Q24, Q19, R37, R34, R43, R40, R45, R49, R50, D24, D25, D26 form the steering logic. Diodes D18, D19, and D20 are also part of the steering logic.

When select signal SEL 1 is activated, D24 and D19 conduct while the other diodes function as open circuits. During the first ⅓ of the selection pulse the staggered pulse REV A is positive turning on Q23 through R43. Q23 makes the base of Q15 negative through R37 with respect to NET A. Q15 and Q9 are turned on making the voltage on left side of solenoid L2 positive. The right side of solenoid L2 is close to supply ground through D19. Under these conditions the solenoid L2 moves to the off position during the first ⅓ of the selection pulse. D1OA and D1OB protect the driver transistors by clamping the spikes generated by the solenoid when the current through the solenoid is abruptly cut off.

ACTUATOR SOLENOID DRIVER 3 AND STEERING LOGIC

Figure 8:
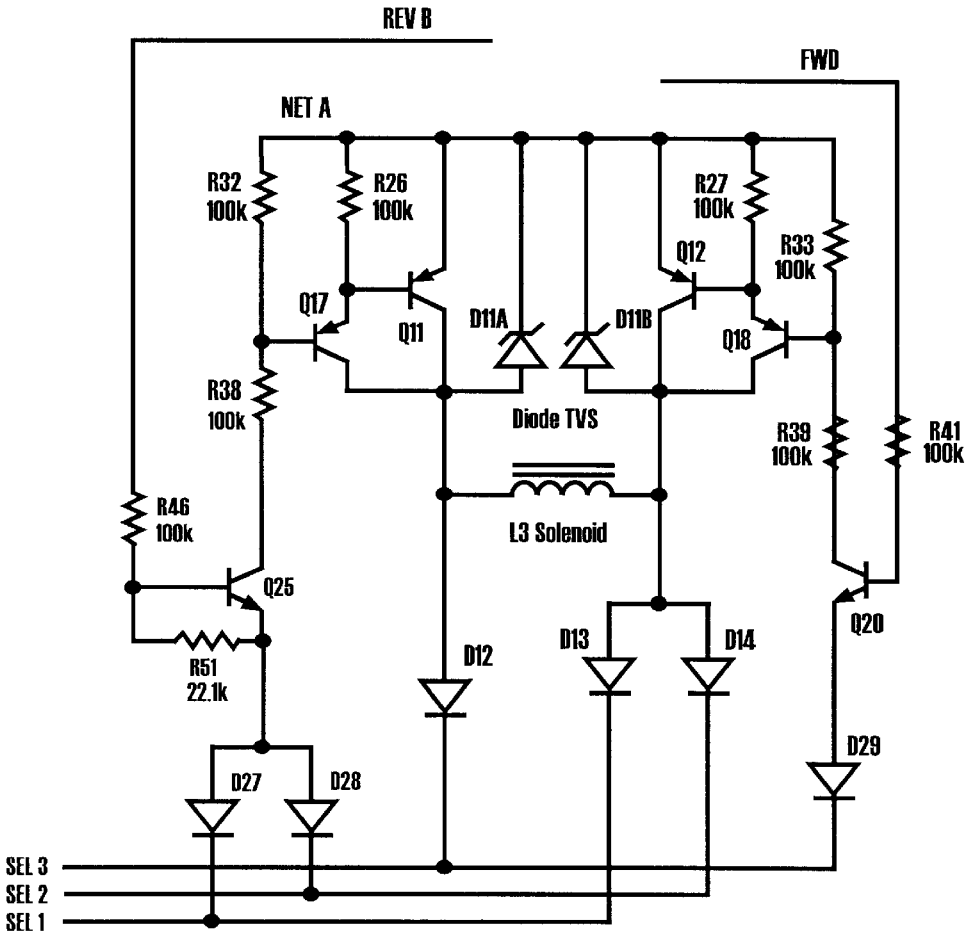
FIG. 8 is a schematic circuit diagram of the third solenoid driver and steering logic of the actuator control circuit of FIG. 4.

FIG. 8 shows the actuator solenoid L3 driver and accompanying steering logic. Q11, Q12, Q17, Q18, R26, R27, R32, R33, D11A, D11B, D12, D13 and D14 form the solenoid driver. Q25, Q20, R38, R39, R46, R41, R51, D27, D28, D29 form the steering logic. Diodes D12, D13, and D14 are also part of the steering logic.

When select signal SEL 1 is activated, D27 and D13 conduct while the other diodes function as open circuits. During the second ⅓ of the selection pulse the staggered pulse REV B is positive turning on Q25 through R46. Q25 makes the base of Q17 negative through R38 with respect to NET A. Q17 and Q11 are turned on making the left side of solenoid L3 positive. The right side of solenoid L3 close to supply ground through D13. Under these conditions the solenoid L3 moves to the off position during the second ⅓ of the selection pulse. D11A and D11B protect the driver transistors by clamping the spikes generated by the solenoid when current through the solenoid is abruptly cut off.

Figure 10:
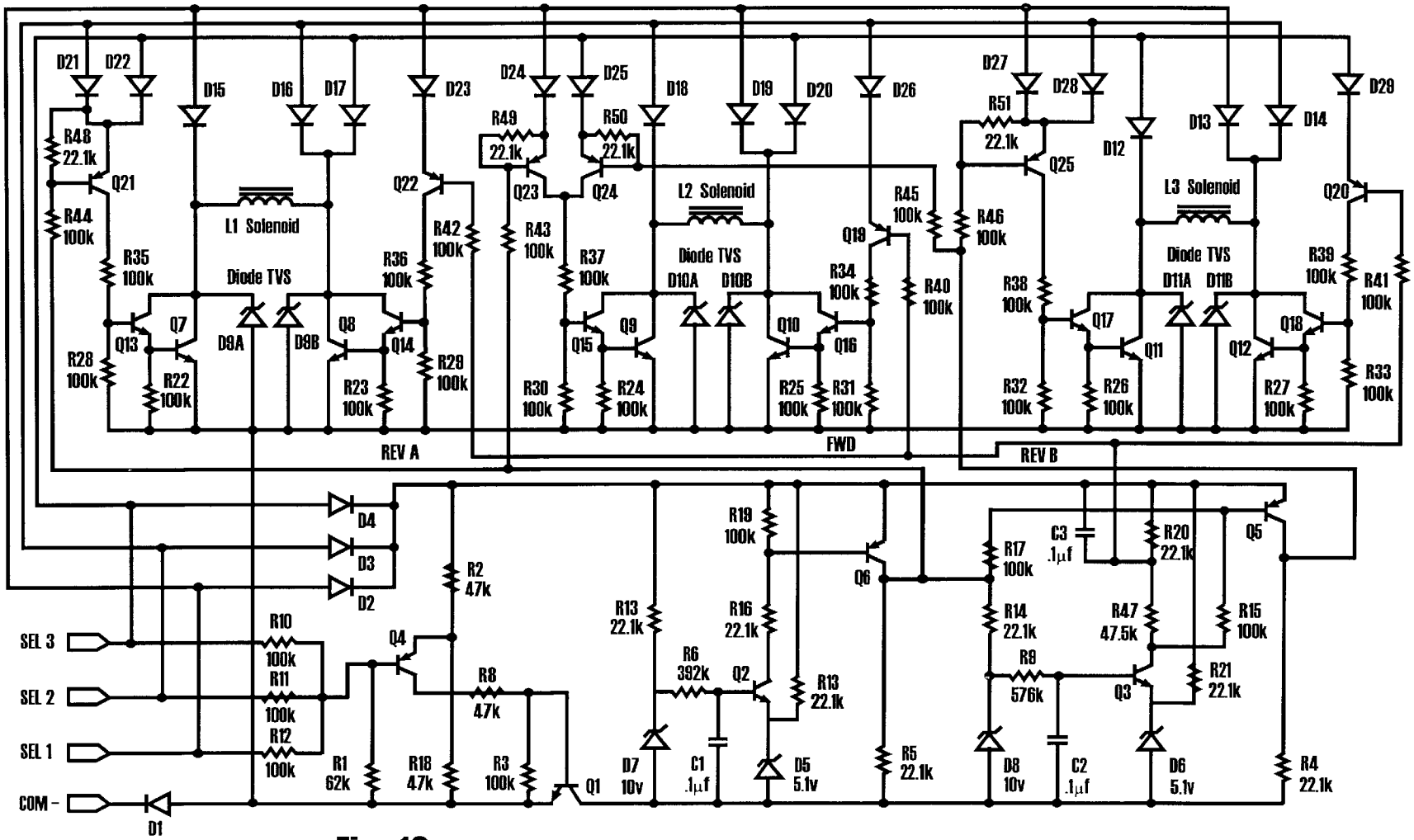
FIG. 10 is a schematic circuit diagram of the actuator control circuit controlling three actuators and having three select signal path inputs for receiving positive input signals.

The embodiment of FIG. 10 shows the multiple actuator control circuit configured to receive positive voltage select pulse signals. This embodiment is identical to that shown in FIG. 4 except that the polarity of the diodes and transistors reversed.

In the embodiments shown in FIGS. 4 and 10, the select signal is anticipated to be a direct current voltage pulse between 14 to 32 volts having a duration of approximately 100 milliseconds. As those in skilled in the art recognize the circuitry and sizing of the components can easily be adapted to account for any variety of direct current voltage pulses. By way of example, the select signals can comprise pulsed direct current signals having a pulse amplitude between about plus or minus 40 volts.

What has been described are preferred embodiments in which modifications and changes may be made without departing from the spirit and scope of the accompanying claims.

What is claimed is:

1. The multiple actuator control circuit for arranging a plurality of actuators into a plurality of predetermined positions by the receipt of a single select signal, said control circuit comprising:

a timing-slicing circuit for arranging and processing said select signal into a plurality of staggered pulse signals;

a steering logic circuit for receiving said pulse signals and generating in response thereto corresponding actuator enable signals; and in which each said actuator receives a said corresponding actuator enable signal and is activated thereby into the predetermined position and wherein said actuator control circuit receives a plurality of separate select signals, each said select signal corresponding to a prearranged configuration of the predetermined position.

2. The multiple actuator control circuit as defined in claim 1 for arranging said plurality of actuators into any one of a plurality of said prearranged configurations only upon the receipt of a single select signal.

3. The multiple actuator control circuit as defined in claim 2 in which said select signals comprise pulsed direct current signals having a pulse amplitude capable of varying between about plus or minus 40 volts.

4. The multiple actuator control circuit as defined in claim 3 in which said pulsed direct current signals have a pulse duration of approximately 100 milliseconds.

5. The multiple actuator control circuit as defined in claim 4 in which said pulsed direct current signals have a current value that can vary between approximately about plus or minus 10 amps.

* * * * *